US007025477B2

(12) United States Patent
Blessing et al.

(10) Patent No.: US 7,025,477 B2
(45) Date of Patent: Apr. 11, 2006

(54) ILLUMINATION APPARATUS

(75) Inventors: Kurt Blessing, Luedenscheid (DE); Hans-Joachim Dietrich, Schwerte (DE); Ralph Wemper, Ennepetal (DE)

(73) Assignee: Insta Elektro GmbH, Luedenscheid (DE)

( * ) Notice: Subject to any disclaimer, the term of this patent is extended or adjusted under 35 U.S.C. 154(b) by 33 days.

(21) Appl. No.: 10/902,576

(22) Filed: Jul. 30, 2004

(65) Prior Publication Data

US 2005/0047131 A1 Mar. 3, 2005

(30) Foreign Application Priority Data

Jul. 31, 2003 (DE) ..... 103 34 970

(51) Int. Cl.
*F21V 17/00* (2006.01)

(52) U.S. Cl. ..... 362/364; 362/800; 362/240; 362/326; 362/368; 362/147; 361/752

(58) Field of Classification Search ..... 362/362, 362/800, 145, 147, 148, 231, 235, 249, 311, 362/326, 364, 368, 240, 251; 361/752, 728–731, 361/735, 736

See application file for complete search history.

(56) References Cited

U.S. PATENT DOCUMENTS

| | | | | |
|---|---|---|---|---|
| 4,868,384 | A * | 9/1989 | Franken et al. | 250/229 |
| 5,565,839 | A * | 10/1996 | Poss | 340/331 |
| 5,757,136 | A * | 5/1998 | Schadhauser | 315/56 |
| 6,234,648 | B1 * | 5/2001 | Borner et al. | 362/235 |
| 6,491,413 | B1 * | 12/2002 | Benesohn | 362/294 |

* cited by examiner

*Primary Examiner*—Sandra O'Shea
*Assistant Examiner*—Sharon Payne
(74) *Attorney, Agent, or Firm*—Oblon, Spivak, McClelland, Maier & Neustadt, P.C.

(57) ABSTRACT

An illumination apparatus which comprises a housing and a circuit board having illuminants, which can be mounted in the housing. In order to provide an illumination apparatus whose housing protects the functional components against hard environmental conditions and mechanical loads to be expected and which has a particularly compact design, the housing substantially comprises a base of annular shape, an intermediate part having a hat-like shape which accommodates the circuit board and has a guiding opening for the connection cables, and a lid part which allows a selective outlet of light.

15 Claims, 5 Drawing Sheets

ILLUMINATION APPARATUS

BACKGROUND OF THE INVENTION

1. Field of the Invention

The present invention relates to an illumination apparatus having a housing and a circuit board having a plurality of illuminants and which can be mounted in the housing and where the housing allows passage of a controlled amount of light.

2. Description of the Background

Illumination devices may be used to illuminate their environment selectively, inside or outside of buildings, to illuminate items in their direct proximity and/or for the selective integration of light in items. For example, if such illumination apparatus are used for installation within ceilings or floors, a compact design is necessary to provide for an installation without difficulties.

An illumination apparatus having a housing and a circuit board having a plurality of illuminants is disclosed in DE 100 26 661 A1. In this illumination apparatus, several illuminants are arranged on a circuit board by means of which they may be connected to a power supply. The circuit board is surrounded by a housing, which allows a selective outlet of light and protects the illuminants effectively against harsh environmental conditions such as humidity, dust, mechanical loads etc. Such an illumination apparatus, however, is of a relative large design, which might be a hindrance in installing it in ceilings and floors of buildings.

SUMMARY OF THE INVENTION

Accordingly, it is an object of the present invention is to provide an illumination apparatus, the housing of which accommodates the functional components and protects them reliably against hard environmental conditions or mechanical loads to be expected, while at the same time being of particularly compact design.

This object is achieved by the illumination apparatus of the invention. The illumination apparatus of the invention is advantageous because it can be produced with low costs and can be integrated without difficulties into its environment such as ceilings, floors, and walls, in a shapely manner.

BRIEF DESCRIPTION OF THE DRAWINGS

By way of exemplary embodiments, the invention illumination apparatus will be described in more detail, with reference to the drawings, in which.

DETAILED DESCRIPTION OF THE INVENTION

Figure 1:
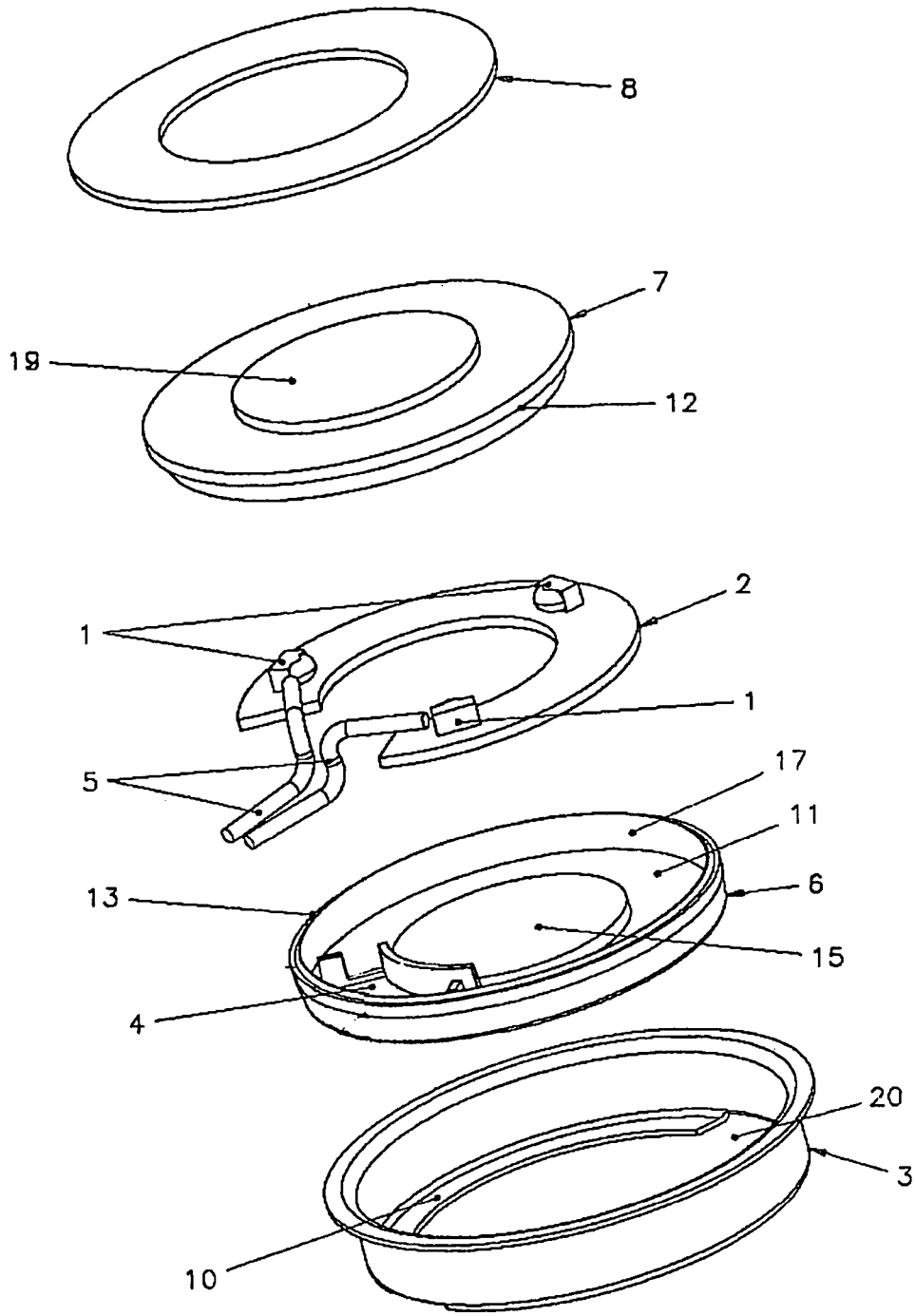
FIG. 1 is an exploded spatial view, which depicts an illumination apparatus schematically.
Figure 2:
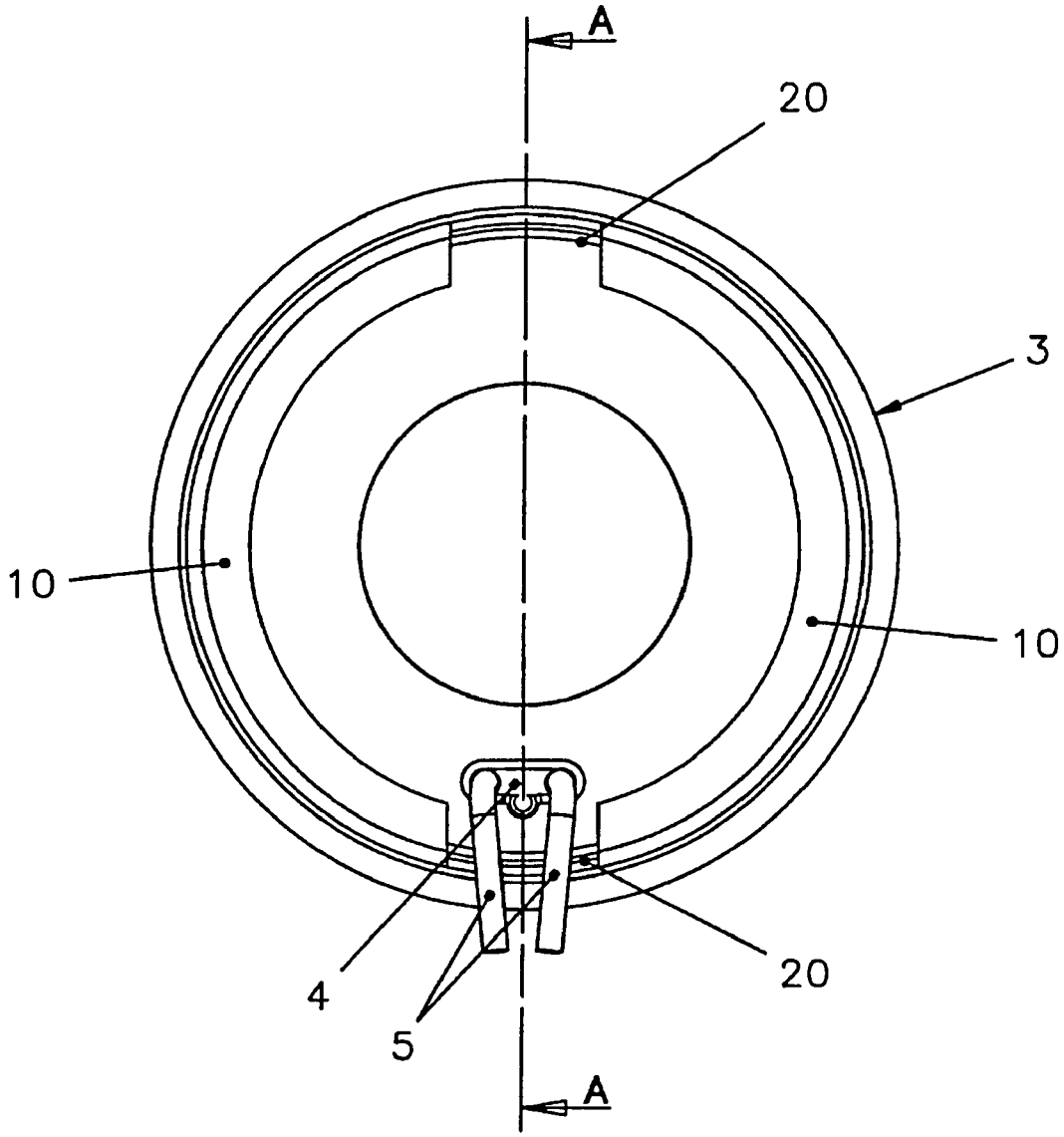
FIG. 2 is a bottom view of the illumination apparatus of FIG. 1.

With reference to the drawings, said illumination apparatus comprises principally a circuit board 2 accommodating the illuminants 1 which is (are) protectively surrounded by a housing.

As further illustrated in the drawings, said housing consists substantially of a base 3 forming the external body, an intermediate part 6 having a hat-like shape which accommodates the circuit board 2 and has a guiding opening 4 for the connection cables 5, and a lid part 7 which allows a selective outlet of light, as well as an annular aperture part 8 mounted thereto.

As shown particularly in FIG. 1, the circuit board 2 has the shape of a horseshoe so that an accommodation space or guiding space is formed for said two connection cables 5. The circuit board 2 is equipped with three illuminants 1 of the type LED. Said three illuminants 1 emit light in red, green and blue color. Furthermore, an electronic control device—which is not shown for reasons of simplicity—is present on the circuit board 2 in order to control said illuminants 1 of the type LED selectively. This enables in a simple way the generation of, for example, any mixed color, lighting effects and so on. In order to ensure a secure contacting of said two connection cables 5 with the circuit board 2 permanently, said connection cables are stuck together with said intermediate part 6 forming a strain relief.

Figure 3:
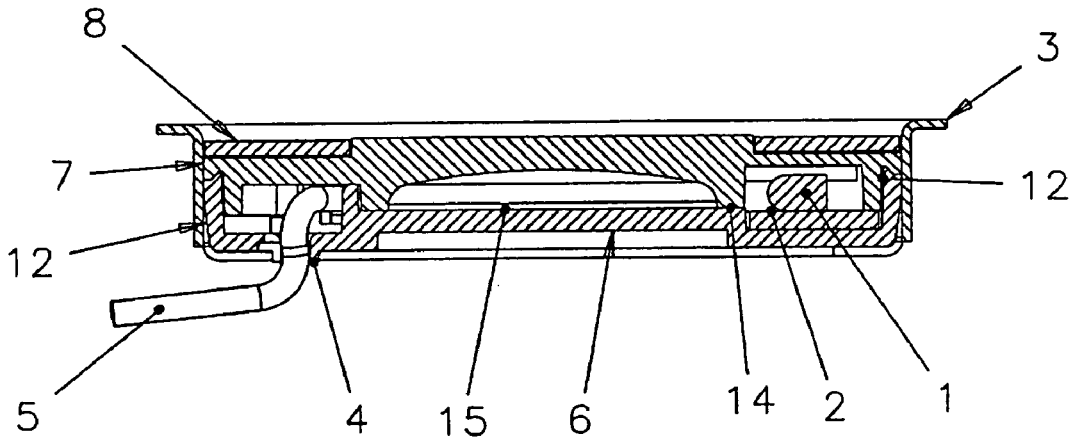
FIG. 3 is a full section of the illumination apparatus along line A—A of FIG. 2.
Figure 4:
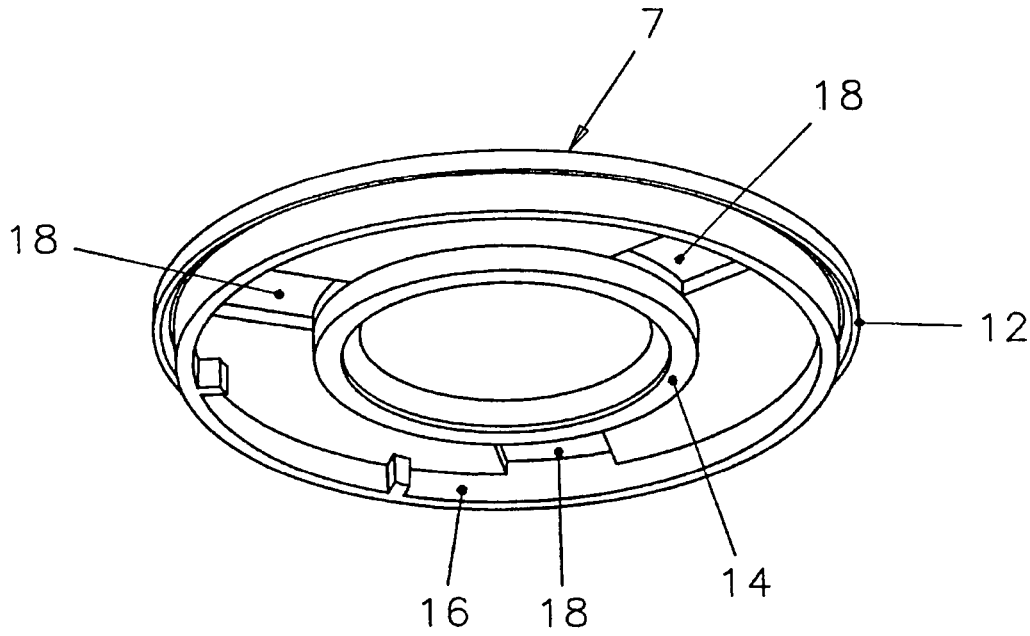
FIG. 4 is a bottom view of the lid part of the illumination apparatus.

As further illustrated particularly in FIG. 1 and FIG. 3, said intermediate part 6, after assembling of the illumination apparatus is completed, comes to lay with its bottom against limiting straps 10 which are formed at the bottom of base 3. An annular groove 11 of said intermediate part 6 accommodates said circuit board 2, said two connection cables 5 being guided to the outside by said guiding opening 4. With reference to FIG. 1, FIG. 3 and FIG. 4, said lid part 7 comes to lay with its outer rim 12 against the outer ring surface 13 of said intermediate part 6. Furthermore, said lid part 7 abuts with its fitting ring 14 formed thereto on the elevation 15 of said intermediate part 6. In addition, a flange 16 formed thereto abuts with positive fit on the inner surface 17 of said intermediate part 6. In order to accommodate said three illuminants 1 of the type LED in a space-saving way, three accommodation chambers 18 are formed on the bottom side of said lid part 7. Said three illuminants 1 of the type LED emit their light laterally, so that the emitted light is guided by means of said fitting ring 14 into said lid part 7. The selective output of the emitted light is realized by an outlet of light 19 of said lid part 7 which might have any shape, said aperture part 8 being shaped according to the shape of said outlet of light 19. Therefore, in this example, the aperture part 8 has an annular shape. In this manner, in a simple and low-priced way, an illumination apparatus having a compact and shapely design is realized, whereby the housing, being particularly robust, protects the damageable components effectively against the loads and hard environmental conditions to be expected when in use.

In order to account particularly for the functional requirements or loads when used as built-in illuminator in floors such as parquet, carpet, laminate and so on as well as in ceilings and walls, but also for use as a conventional illuminator, said base 3 is made of decorative metal, said intermediate part 6 and said aperture part 8 are made of plastics which is impervious to light, and the lid part 7 on the whole is made of translucent plastics.

Figure 5:
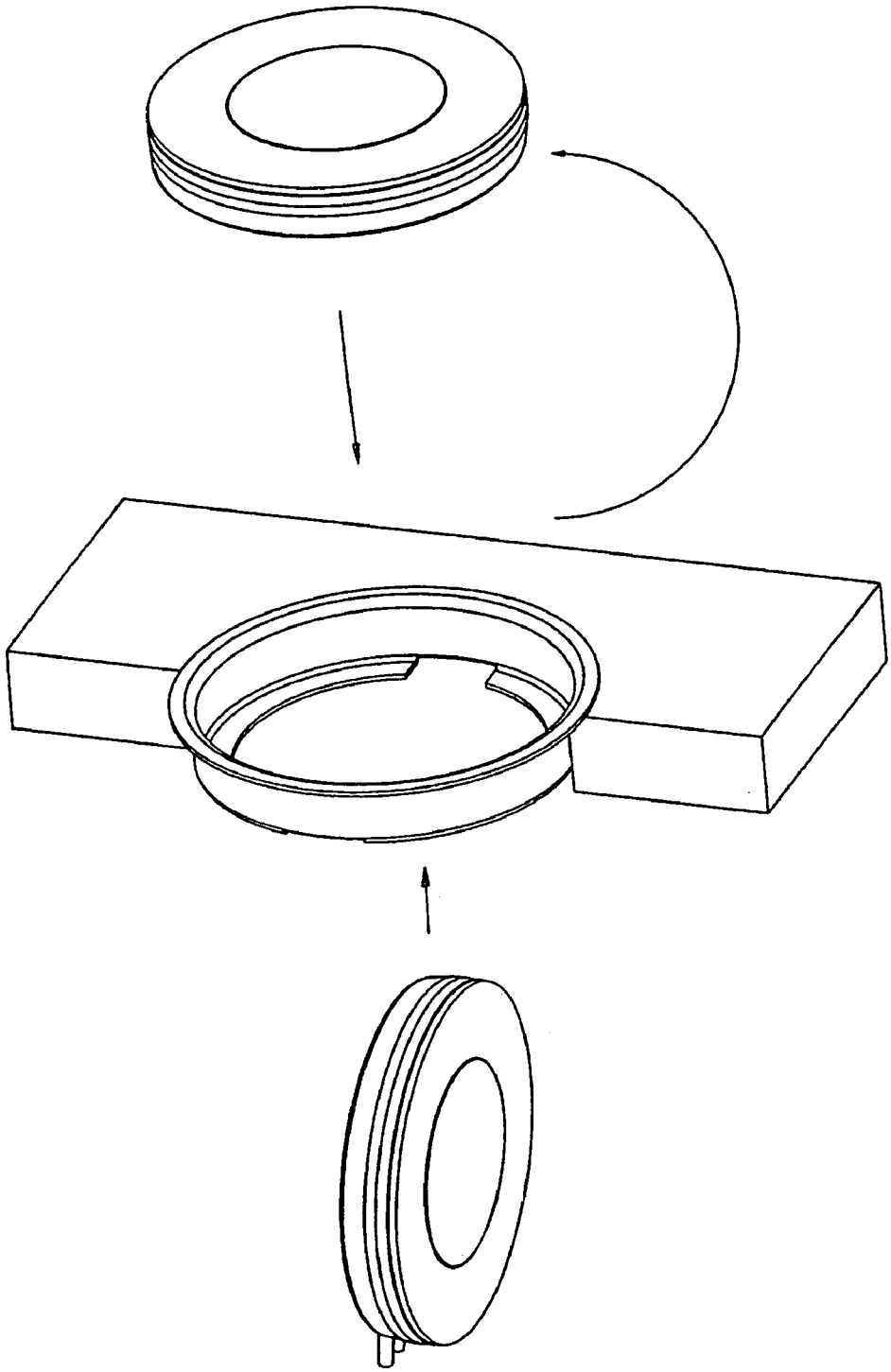
FIG. 5 illustrates schematically a proper method for the installation of the illumination apparatus in situ.

Said two limiting straps 10 of said base 3 are separated from each other by means of two recesses 20 which are arranged opposite to one another. The dimension of said two recesses 20 are such that, when installing the illumination apparatus in its destination, the assembly comprising said intermediate part 6, said circuit part 2, and said lid part 7 with said two connected connection cables pass through said housing part 3 from below, as particularly illustrated in FIG. 5.

Obviously, additional modifications and variations of the present invention are possible in light of the above teachings. It is therefore to be understood that within the scope of the appended claims, the invention may be practiced otherwise than as specifically described herein.

German application DE 103 34 970.7-54, filed on Jul. 31, 2004, is incorporated herein by reference in its entirety.

The invention claimed is:

1. An illumination apparatus comprising a plurality of illuminants, a circuit board, a power supply, a means of connecting the power supply to the illuminants, and a housing, wherein the illuminants are arranged on the circuit board, wherein the circuit board is surrounded by the housing and the housing is capable of selective outlet of light, wherein the housing comprises at least a hat-shaped intermediate part accommodating the circuit board and having a guiding opening for one or more connection cables; a base having an annular shape; and a lid part capable of selective outlet of light, wherein the circuit board has an annular section configured to a lower annular groove on the intermediate part.

2. The illumination apparatus according to claim 1, wherein the circuit board is in the form of a closed ring.

3. The illumination apparatus according to claim 1, wherein the circuit board is in the form of an open ring.

4. The illumination apparatus according to claim 1, wherein at least the circuit board comprises one or more strain relievers for the connection cables.

5. The illumination apparatus according to claim 1, wherein at least the intermediate part of the housing further comprises one or more strain relievers for the connection cables.

6. The illumination apparatus according to claim 1, wherein the lid part has at least one aperture part and the aperture part is capable of selective outlet of light.

7. The illumination apparatus according to claim 1, wherein at least a part of the housing comprises a translucent plastic.

8. The illumination apparatus according to claim 1, wherein the lid part comprises a light decoupling structure capable of selective outlet of light.

9. The illumination apparatus according to claim 1, wherein at least one of the illuminants arranged on the circuit board is an LED.

10. The illumination apparatus according to claim 1, wherein the illuminants emit light in at least two different colors.

11. The illumination apparatus according to claim 1, further comprising a control device for controlling the illuminants wherein the illuminants are in direct connection with the control device.

12. The illumination apparatus according to claim 11, wherein the control device is present on the circuit board.

13. The illumination apparatus according to claim 11, wherein the control device is separate from the circuit board.

14. The illumination apparatus according to claim 1, wherein the base comprises two limiting straps formed thereto.

15. The illumination apparatus according to claim 1, wherein the means of connecting the illuminants to the power supply is the circuit board.

* * * * *